United States Patent [19]

Mabuchi et al.

[11] 4,213,293

[45] Jul. 22, 1980

[54] RECEIVING UNIT FOR TIMEPIECES

[75] Inventors: Hiroshi Mabuchi, Tokyo; Isao Yabe, Tokorozawa, both of Japan

[73] Assignee: Citizen Watch Co., Ltd., Tokyo, Japan

[21] Appl. No.: 950,055

[22] Filed: Oct. 10, 1978

[30] Foreign Application Priority Data

Oct. 15, 1977 [JP] Japan ..... 52-138424[U]

[51] Int. Cl.[2] ..... G04B 3/12; G04B 5/04

[52] U.S. Cl. ..... 368/152; 368/151; 368/208

[58] Field of Search ..... 58/7, 41 R, 41 A, 41 B, 58/52 A, 80, 82 R, 82 A, 83 R, 59, 104, 40, 46 R, 46 W, 48, 75, 83 A

[56] References Cited

U.S. PATENT DOCUMENTS

| | | | |
|---|---|---|---|
| 3,543,506 | 12/1970 | Dubois et al. | 58/82 A |
| 4,128,992 | 12/1978 | Egger et al. | 58/23 D |

FOREIGN PATENT DOCUMENTS

| | | | |
|---|---|---|---|
| 252573 | 1/1948 | Switzerland | 58/82 A |

*Primary Examiner*—Edith S. Jackmon

*Attorney, Agent, or Firm*—Sherman & Shalloway

[57] ABSTRACT

A receiving unit for timepieces, especially an improved receiving unit for a self-winding mechanism of self-winding timepieces. The receiving unit comprises guide portions and springs which are formed together as a unitary structure using resin.

10 Claims, 3 Drawing Figures

RECEIVING UNIT FOR TIMEPIECES

BACKGROUND OF THE INVENTION

1. Field of the Invention

This invention relates to receiving units for timepieces, and specifically to improved receiving units for a self-winding mechanism of self-winding timepieces.

2. Description of the Prior Art

Heretofore, a variety of improvements were contrived for the wrist watches, and particularly for the self-winding timepieces. Among them, the self-winding timepieces of the reverser type required simplified mechanical parts and were suited for reducing the manufacturing cost. It has also been known that the winding performance is not lost even with the self-winding timepieces which wind in one direction only.

The conventional timepieces of this sort, however, presented a problem when it was attempted to further reduce the manufacturing cost. FIG. 1 shows a wheel train of a conventional self-winding mechanism of the reverser type which winds in one direction only. In the drawing, reference numeral 2 denotes a weight wheel pinion in a self-winding mechanism, which is in mesh with a reverser 4. The reverser 4 is guided through an elongated hole 3*a* of a receiving unit 3 and a guide portion 22*a* of a metallic receiving unit 22, and is biased by a reverser spring 19. One end of the reverser spring 19 is attached by caulking to a slit formed in the metallic receiving unit 22. The motion of the reverser 4 is transmitted to a square-holed wheel (not shown) through reduction wheels 6 and 7. The reduction wheel 6 is engaged with a click 21 of a self-winding mechanism, and is pivotted to the receiving unit 3 being urged by a click spring 20. The click spring 20 is mounted on the receiving unit 3 by means of a pin 20*a* and a screw 20*b*.

It was required that the reverser spring 19 and the click spring 20 of the aforementioned prior art must have a resilient force which was as small as about 1 gram, so that the winding performance of the self-winding mechanism was not decreased. Therefore, these springs 19 and 20 usually consisted of a leaf spring having a thickness of about 50 microns. It was, however, very difficult to prepare such springs because of warping of the spring material and dispersion in quality developed during the step of bending. The reverser spring 19 and the click spring 20 could be secured as shown in FIG. 1, requiring clumsy operation in attaining the proper position and in performing the assembling, eventually making it difficult to automatically manufacture the timepieces in large quantity. Furthermore, the receiving unit required slits for fastening these springs, pins for determining the positions or screw-taps. For this purpose, increased processing steps were needed, and a special processing must be effected to attain high dimensional precision in the hole for rotatably holding the reverser shaft and in the guide portions of the self-winding mechanism, such as holes for holding the reduction wheels, thereby to obtain smooth sliding surfaces.

SUMMARY OF THE INVENTION

The principal object of this invention is to provide a receiving unit for timepieces eliminating the aforementioned defects inherent in the prior art.

Another object of this invention is to provide a receiving unit for timepieces at a reduced cost, which can be easily manufactured in large quantity.

A further object of this invention is to provide a receiving unit for timepieces, which is capable of strikingly enhancing the precision between a position at the tip of the reverser spring and a position of the reverser shaft or the click.

Yet further object of this invention is to provide a receiving unit for timepieces, with which the resilient force of the spring is weakened and stabilized within short periods of time even if the position at the tip of the spring is deviated.

Still another object of this invention is to provide a receiving unit for timepieces, which is very safe in handling and which permits easy assembling.

A further object of this invention is to provide a receiving unit for timepieces, which helps reduce the total weight of the timepieces.

PREFERRED EMBODIMENT OF THE INVENTION

Figure 1:
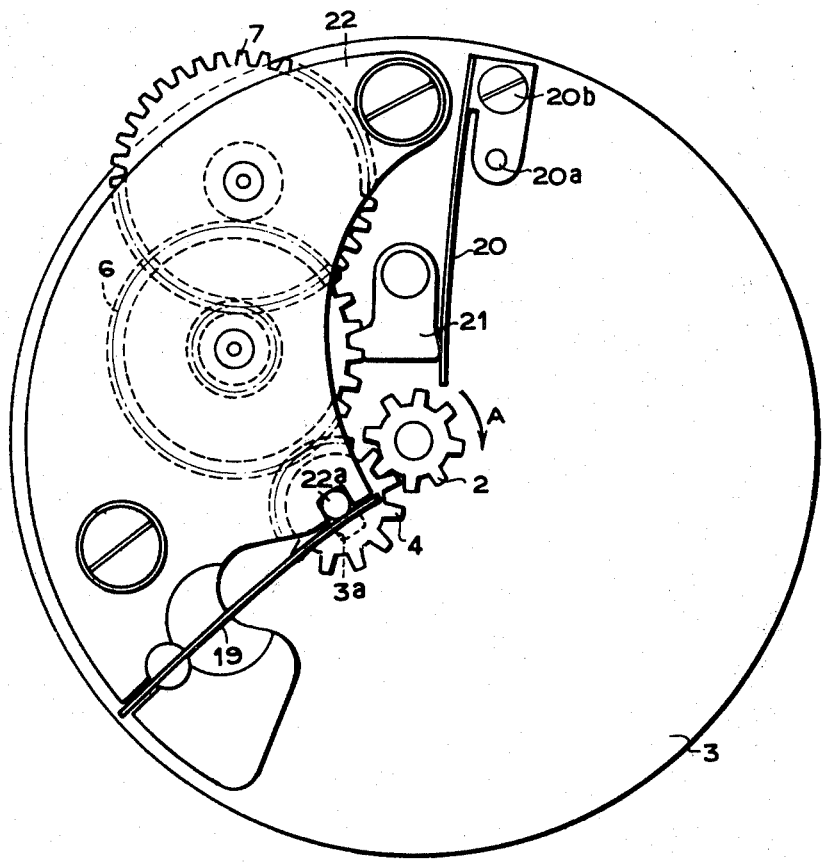
FIG. 1 is a plan view showing a receiving unit for a self-winding mechanism of a conventional self-winding timepiece of the reverser type which winds in one direction only.
Figure 2:
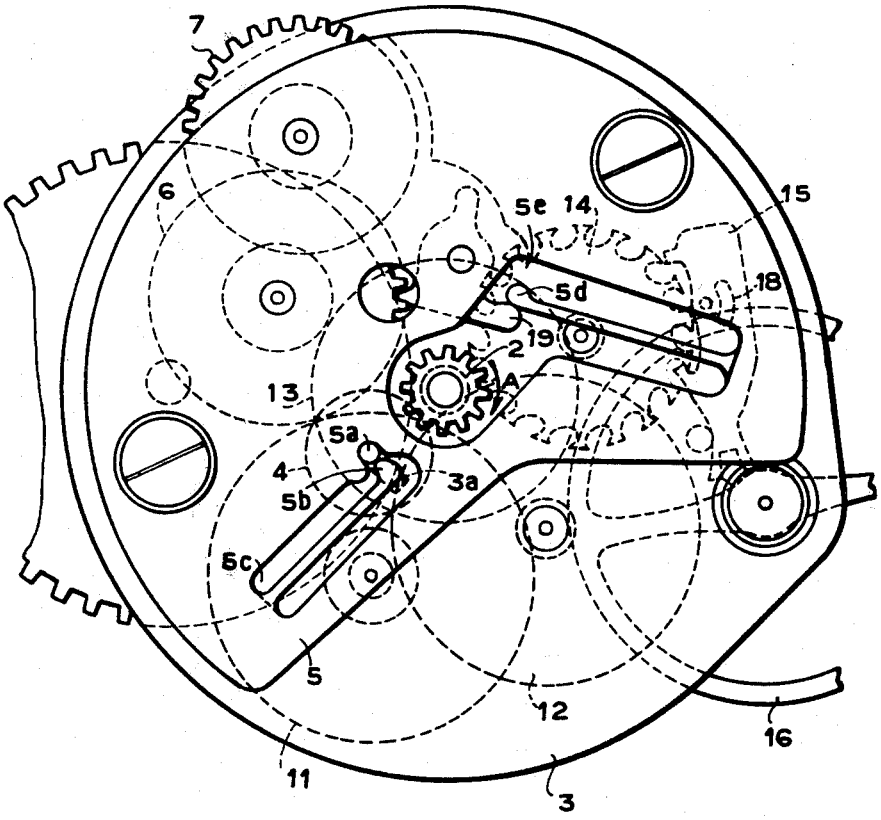
FIG. 2 is a plan view showing a receiving unit for timepieces according to an embodiment of this invention.
Figure 3:
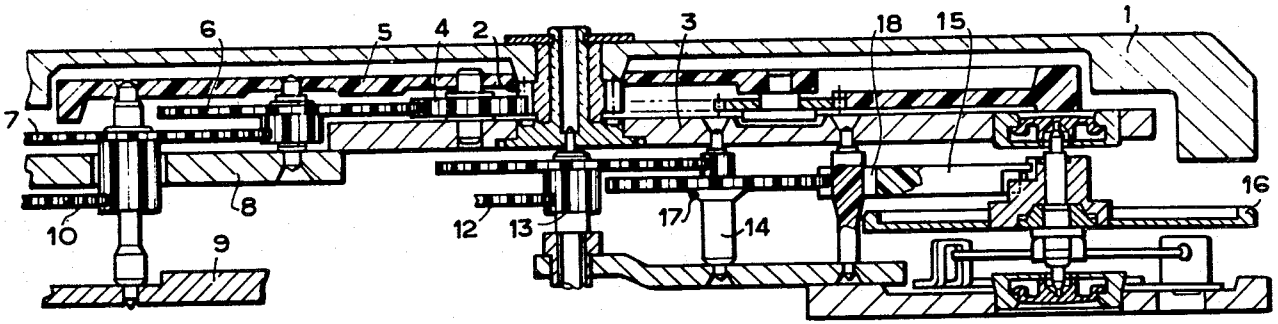
FIG. 3 is a cross-sectional view showing a major portion of FIG. 2.

FIG. 2 and FIG. 3 show an embodiment of this invention, in which reference numeral 1 represents a weight of the self-winding device. The weight 1 is pivotally mounted on a receiving unit 3 by means of a weight wheel pinion 2. A reverser 4 is supported by a shaft guide 5*a* of a receiving unit 5 of the self-winding mechanism and an elongated hole 3*a* of the receiving unit 3. The reverser 4 therefore is allowed to move until it is disengaged from a reduction wheel 6. Under ordinary condition, however, a shaft portion 4*a* of the reverser 4 is urged toward the reduction wheel 6 by a reverser spring 5*b* which is formed in a window 5*c* integrally with the receiving unit 5 of the self-winding mechanism, the reverser spring 5*b* having a thickness smaller than the thickness of the receiving unit 5. A click 19 of the self-winding mechanism is pivotted by a revet to the receiving unit 3 of the self-winding mechanism and is in mesh with the reduction wheel 6 being urged by a spring 5*d* which is formed in a window 5*e* like the above-described spring 5*b*. Here, the receiving unit 5 which is wholly made of a plastic material according to this embodiment supports the shafts of reduction wheels 6 and 7, springs 5*b* and 5*d*, as well as a guide portion 5*a*. The springs 5*b* and 5*d* are surrounded by the receiving unit 5, and are cross-sectionally accommodated in the thickness of the receiving unit 5 such that they are prevented from being elastically deformed by abnormal force during the handling. The reduction wheels 6 and 7 are pivotally supported between the receiving unit 5 of the self-winding mechanism and a receiving unit 8 and between the receiving unit 5 and a base plate 9. The reduction wheel is in mesh with a squre-holed gear 10. A complete barrel with arbor (not shown) drives a balance 16 via a center wheel assembly 11, a third wheel assembly 12, a fourth wheel assembly 13, an escape wheel assembly 14, and an anchor escapement 15. The balance, the anchor escapement and the wheel train on the surface are pivotally supported by the receiving units and the base plate in a customary manner and are constructed in a customary manner. The escape wheel assembly and the anchor escapement are wholly made of a plastic material as unitary structures, wherein the escape wheel assembly has a pouring gate 17 at the center and the anchor escapement has a hole 18.

Rotational movement of the weight wheel pinion 2 in the direction of allow A is transmitted to the reduction wheel 7 while pushing up the click 19 overcoming the force of the spring **5*d* thereby to wind up the mainspring anchored to the reduction wheel 7. When the weight wheel pinion 2 is rotated in the direction opposite to arrow A, the reverser 4 is caused to move against the force of the spring 5*b*, whereby the reduction gear 6 is clamped by the click to receive the force of the mainspring. The movement from a barrel drum (not shown) to the balance 16** is the same as that of the prior art.

According to this invention in which the springs are formed together with the receiving unit as a unitary structure, there is required no operation for determining the positions of the springs or for fastening them. In addition, the unitary structure enables the shapes of the springs to be directly derived from a reference position of the receiving unit maintaining precision, making it possible to strikingly enhance the stability in position between the tip of the spring and the reverser shaft, and between the tip of the spring and the click. The resin further exhibits such a desirable property that even if the position at the tip of the spring is deviated causing the deflection of the spring to be increased and eventually causing the resilient force of the spring to be increased, the creeping phenomenon of the resin enables the resilient force to be reduced and stabilized within brief periods of time. Moreover, since the spring portions are formed being acommodated in the receiving unit, safety can be very enhanced during the handling, and the assembling operation can also be facilitated. Furthermore, the receiving units of this invention make it possible to easily form the guide portion for the reverser shaft, shaft holes for reduction wheels and the like, that were difficult with the conventional metallic receiving units. Besides, use of the resin contributes to reduce the weight of the timepieces, thus giving very great effects.

Although the receiving units of the self-winding mechanism of the reverser type were mentioned in the foregoing, it should be noted that the receiving units of this invention can also be used for any self-winding mechanism of any timepieces to provide the same effects.

What is claimed is:

1. In a receiving unit for timepieces arranged to support a self-winding mechanism having a weight wheel pinion secured to a weight, a reduction wheel train for transmitting the rotational movement of said weight wheel pinion to a main spring to wind up said main spring, and a control means for controlling said reduction wheel train, the improvement comprising:

(a) a bearing portion provided on and integral with said receiving unit for rotatably supporting said reduction wheel train;

(b) a cutout formed in a predetermined position of said receiving unit; and (c) said control means including a leaf spring integral with said receiving unit and projecting into said cutout from said receiving unit and a movable member movably arranged on said receiving unit to be urged in a given direction by means of said leaf spring.

2. The receiving unit for timepieces as set forth in claim 1, wherein said leaf spring has a thickness less than a thickness of said receiving unit.

3. The receiving unit for timepieces as set forth in claim 1, wherein said cutout is an opening within said receiving unit completely surrounded by said receiving unit and wherein said leaf spring is located within said opening.

4. The receiving unit for timepieces as set forth in claim 1, wherein said control means further includes a reversing mechanism and said movable member is a reverser wheel engaging said weight wheel pinion and a reduction wheel of said reduction wheel train.

5. The receiving unit for timepieces as set forth in claim 4, wherein said receiving unit further comprises a guide adjacent an end portion of said leaf spring, said guide formed along a part of the outline of said cutout and wherein a shaft supporting said reverser wheel is located between said guide and said end portion of said leaf spring to control the movement of said reverser wheel.

6. A receiving unit for timepieces as set forth in claim 1, wherein said control means is a click mechanism and said movable member is a click lever engaging a reduction wheel of said reduction wheel train.

7. The receiving unit for timepieces as set forth in claim 1 wherein said unit is comprised of plastic.

8. In a receiving unit for timepieces arranged to support a self-winding mechanism having a weight wheel pinion secured to a weight, a reduction wheel train for transmitting the rotational movement of said weight wheel pinion to a main spring to wind up said main spring and having first and second control means for controlling said reduction wheel train, the improvement comprising:

(a) bearing portions provided on said receiving unit for rotatably supporting said reduction wheel train;

(b) first and second windows formed in predetermined positions of said receiving unit, said windows completely surrounded by said receiving unit;

(c) first and second leaf springs integrally formed with said receiving unit and projecting into said windows;

(d) said first control means being a reversing mechanism comprised of a reverser wheel, said first leaf spring and a guide portion;

(e) said reverser wheel engaging said weight wheel pinion and said reduction wheel train;

(f) said first leaf spring arranged to urge said reverser wheel in a given direction;

(g) said guide portion formed in said receiving unit to support said reverser wheel;

(h) said second control means comprising a click mechanism having a click lever engaging said reduction wheel, said second leaf spring arranged to urge said click lever in a given direction; and (i) said bearing portions, first and second leaf springs and said guide portion integrally forming a unitary structure.

9. The receiving unit for timepieces as set forth in claim 8 wherein said unit is comprised of plastic.

10. The receiving unit for timepieces as set forth in claims 8 or 9 further including a second receiving unit associated with said receiving unit and forming a space therebetween for accommodating said reduction wheel train, said reverser wheel and said click lever.

* * * * *